United States Patent [19]

Gozzi

[11] 4,243,465

[45] Jan. 6, 1981

[54] APPARATUS FOR JOINING PIECES OF LAMINAR MATERIAL AND IN PARTICULAR PLYWOOD CORE STRIPS

[76] Inventor: Ilia Gozzi, Via Milano, 147, Cogozzo di Viadana, Mantova, Italy

[21] Appl. No.: 2,779

[22] Filed: Jan. 11, 1979

[51] Int. Cl.[3] ..... B27D 3/04; B30B 5/04

[52] U.S. Cl. ..... 156/362; 100/151; 156/363; 156/366; 156/558; 156/559; 156/580.1

[58] Field of Search ..... 156/558, 559, 580, 583.5, 156/351, 362, 363, 366, 266, 512, 580.1, 73.2, 499; 144/281 B, 314 A, 309 P, 281 R; 100/93 RP, 151, 152, 154

[56] References Cited

U.S. PATENT DOCUMENTS

| | | | |
|---|---|---|---|
| 2,488,759 | 11/1949 | Bolling | 156/558 |
| 2,555,325 | 6/1951 | Doane | 156/351 |
| 2,705,514 | 4/1955 | Reece | 144/281 R |
| 3,021,248 | 2/1962 | Mann et al. | 156/558 |
| 3,133,850 | 5/1964 | Alenius | 156/558 |
| 3,378,430 | 4/1968 | Alzawa | 100/93 RP |
| 3,490,974 | 1/1970 | Jacobson | 156/558 X |
| 3,526,554 | 9/1970 | Obeda | 156/73.1 |
| 3,963,555 | 6/1976 | Zweig | 156/558 X |
| 4,042,440 | 8/1977 | Hasegawa et al. | 156/363 |

*Primary Examiner*—Michael G. Wityshyn
*Attorney, Agent, or Firm*—Guido Modiano; Albert Josif

[57] ABSTRACT

An apparatus for joining plywood core strips comprises a feeding conveyor floor for the wood strips to be jointed, a crowding conveyor floor therefore and pressure elements, effective to press the wood strips against the feeding and crowding conveyor floors. Each pressure element includes a rod having its front end bent upwardly and supported by the machine frame through a kinematic train including a pneumatic cylinder urging the rod against the underlying conveyor floor. Alignment means including stop pawls and sensors controlling the actuation of the stop pawls are provided to align the strips perpendicular to the feeding direction, as well as jointing material applying means.

8 Claims, 2 Drawing Figures

APPARATUS FOR JOINING PIECES OF LAMINAR MATERIAL AND IN PARTICULAR PLYWOOD CORE STRIPS

BACKGROUND OF THE INVENTION

This invention relates to an apparatus for joining pieces of laminar material and in particular plywood core strips.

Machines have been proposed which join together wood strips intended for making up the core plies of plywood, or veneer strips in general, by applying thereon the jointing material such as adhesive tapes or threads in a perpendicular direction to the strip edges, and utilize a technique consisting in providing a succession of entraining conveyor floors, whereon the strips to be jointed edgewise are placed, and suitable pressure mechanisms capable of maintaining the strips in contact with such conveyor floors; these conveyor floors, which are composed each of a series of coplanar parallel conveyor belts arranged in spaced side-by-side relationship are characteristically driven at decreasing speeds, thereby the entrainment of the wood strips to be jointed towards the jointing material applying means is performed with a progressive slowing down of the foremost strips and consequent contacting therewith of the strips sequentially advanced from the feeding conveyor floor to the subsequent crowding conveyor floor coplanar therewith.

Known pressure mechanisms include pressing conveyor floors arranged above the entraining conveyor floors and adapted to press the wood strips against the underlying conveyor floors.

An example for this technique is described, for example, in U.S. Pat. Nos. 2,705,514 or 2,488,759.

The use of pressing conveyor floors of the above described type had among others the following drawbacks:

(a) The strips to be processed were clamped between the belts of the conveyor floors and entrained by both of them so that a sliding movement between the strips and the belts was difficult, thereby the crowding of the strips at the slower advancing conveyor floor was either impossible or caused excessive stresses both on the strips and the conveyor belts.

(b) The pressing conveyor floors require a complicated energy consuming driving and supporting mechanism, which occupied precious space above the entraining conveyor floors, thereby preventing adequate arrangement of devices for the transverse alignment of the strips and the devices for the application of the jointing material on the strips, in addition to the increased costs of the apparatus.

SUMMARY OF THE INVENTION

This invention is aimed at resolving the problems inherent in the removal of the above indicated drawbacks from the apparatuses for joining pieces of laminar material to better the efficiency, increase the output and to reduce the manufacturing, maintenance and operational costs.

For the purpose there is provided according to the invention an apparatus for joining pieces of laminar material, in particular wooden strips for plywood cores, including a plurality of successive coplanar conveyor floors, each consisting of a series of coplanar and parallel conveyor belts arranged in spaced side-by-side relationship, said plurality of successive coplanar conveyor floors including at least one feeding conveyor floor and at least one crowding conveyor floor arranged after the feeding conveyor floor and having its conveyor belts moving at a speed slower than that of the feeding conveyor floor belts to allow the crowding thereon of the strips to be joined, and pressure mechanisms for holding the strips in contact with the conveyor floors, wherein according to the improvement the apparatus is characterized in that the pressure mechanisms comprise at least one rod-like element arranged over at least part of the longitudinal extension of said successive conveyor floors, said rod-like element having a smooth lower surface facing the conveyor floors and mechanically controlled support means for the rod-like element allowing said rod element to lie under controlled pressure against the strips to be joined entrained by the conveyor floors, alignment means arranged between said rod-like elements for aligning the strips to be joined in a direction perpendicular to the longitudinal extension of the conveyor floors and jointing material applying means.

BRIEF DESCRIPTION OF THE DRAWINGS

These and other functional and constructional features of the invention will be more apparent from the detailed description which follows relating to a possible preferred embodiment of the invention, wherein a single crowding conveyor floor is provided and the jointing material is an adhesive-coated thread, the embodiment being shown in the accompanying drawings, in which.

DESCRIPTION OF THE PREFERRED EMBODIMENTS

Figure 2:
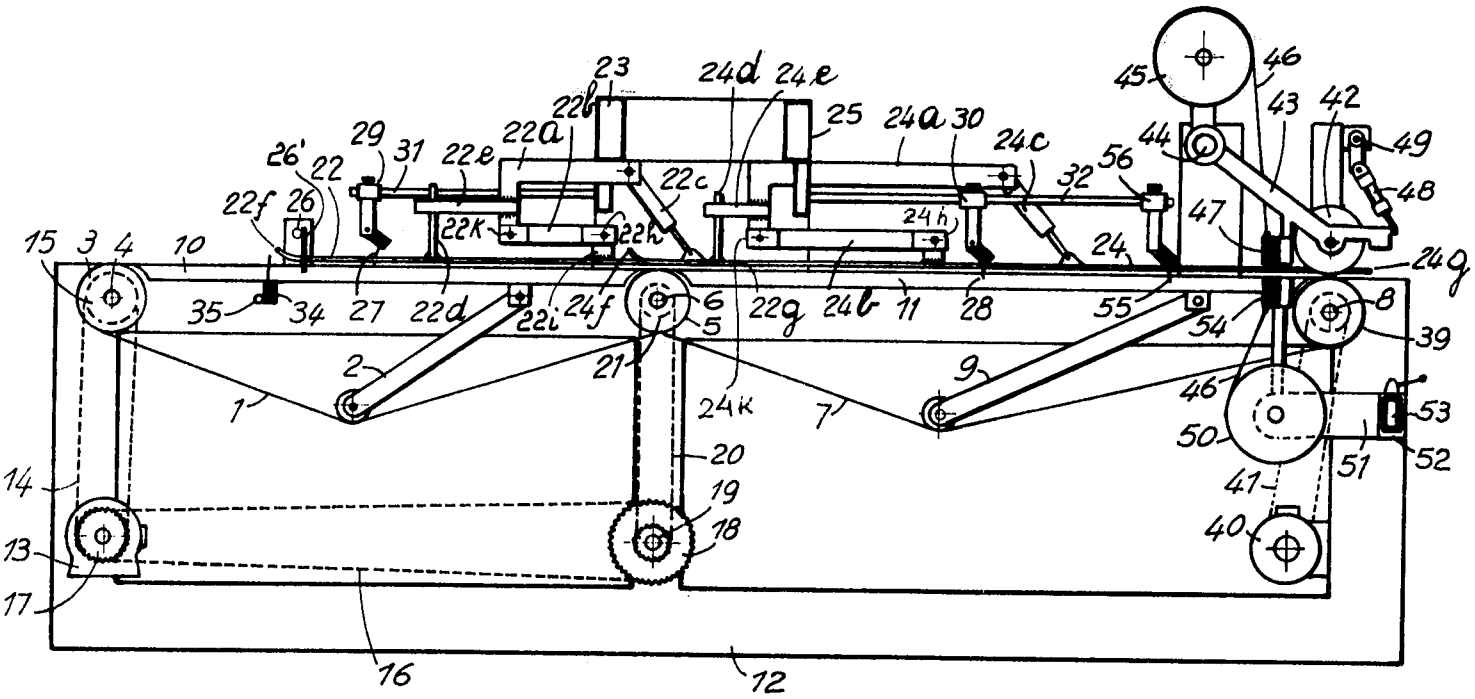
FIG. 2 is a sectional view of the apparatus taken along the plane II—II of FIG. 1.

With reference to the cited drawing figures, there are indicated at 1 the belts which form the feeding conveyor floor, whereon an operator, located at the machine input end, disposes the strips to be joined edgewise, such belts, being equipped with a belt tensioner 2, are run between drive pulleys, such as the one indicated at 3 in FIG. 2, which are keyed rigidly to a shaft 4, and pulleys, such as the one indicated at 5, also in FIG. 2, which are idly mounted to the shaft 6.

The belts of the crowding conveyor floor are indicated at 7 and are run between drive pulleys which are keyed rigidly to the shaft 6 and pulleys which are idly mounted to a shaft 8, neither being shown in FIG. 2, since they remain hidden respectively behind the pulley 5 and one of the splicing rollers which, as explained hereinafter, is also mounted to the shaft 8; the belts 7 are equipped with a belt tensioner 9.

Bars 10 and 11, being carried by the stationary frame structure 12 of the machine, form a supporting and abutment element, respectively for the belts 1 and 7 of the feeding and crowding conveyor floors.

The motion is derived, for either conveyor floors, from an electric motor 13; a sprocket chain 14 transfers the motion to a sprocket wheel 15 which is keyed rigidly to the shaft 4, a chain 16 transmitting the motion, through a speed reducer, between the sprockets 17 and 18; the latter is rigid with the sprocket wheel 19, wherefrom motion is derived through a chain 20 for the sprocket wheel 21, which is keyed rigidly to the shaft 6.

Overlying each of the belts 1 of the feeding conveyor floor and each of the belts 7 of the crowding conveyor floors, are respective pressure elements which are operative to press or bias the wooden strips against said conveyor floors, such as to cause the same to move under frictional engagement. Each of the pressure elements overlying the feeding conveyor floor consists of a rod 22 connected by an articulated link connection to a stationary arm 22*a*, which extends from a crossmember 23 of the machine frame, through a rocker arm 22*b* pivoted in 22*k* and on which the rod 22 is hinged in 22*h* by means of a lug 22*i* rigid therewith. The rod 22 is pushed towards the belt 1 by a pneumatic cylinder 22*c*, the pressure of which may be adjusted. From the rod 22, there extends a lug 22*d* which is slidably guided by fork-like guides 22*e*, rigid with the arm 22*a* to prevent lateral inclinations of rod 22. The front end 22*f* of the rod 22, bent upwardly to provide a flaring inlet for the strips to be processed, is positioned substantially at the wood strip aligning mechanism, which will be explained hereinafter, whereas the rear end 22*g* protrudes with respect to the belt 1, to extend over a contiguous end portion of the belt 7. The rod 22 has a smooth lower surface facing the strips to be joined.

Quite similar to the above is the construction of the pressure elements or pushers overlying the belts of the crowding conveyor floor. One thereof shown in FIG. 2 is formed by a rod 24 kinematically supported by the stationary arm 24*a*, connected to the crossmember 25 through a rocker arm 24*b*, and pushed by pneumatic cylinder 24*c*. From rod 24 a lug 24*d* extends which is slidably guided by the fork-like guides 24*e*. It will be understood that the kinematic connection of the rod 24 is analoguous to that of rod 22. The front end 24*f* of the rod 24 is positioned substantially at the pulleys which are keyed to the shaft 6, and the rear end 24*g* is in a more forwardly located position with respect to the jointing rollers which will be described hereinafter.

The aligning mechanism for the strips to be joined together edgewise comprises a shaft 26 with stop pawls 26' rigid therewith and shown in the drawing figures in a strip stopping position. The rotational movement of the mechanism is controlled by per se known strip contacting sensors 27 and 28, which are adjustably supported by sliders 29 and 30 slidably supported on the guides 31 and 32, following consent by the sensors 33 and 34 which are removably attached to a rod 35, in conformity with the modes explained hereinafter, with reference to the machine operation.

The jointing material applying means comprise three mechanisms, indicated in FIG. 1 at 36,37 and 38, whereof the one indicated at 37 will be described in detail with reference to FIG. 2. Such a mechanism consists of one of the rollers 39 rigidly keyed to the shaft 8, which is driven to rotate by a variable speed electric motor 40 through a chain 41, and a roller 42 which is supported idly on the arm 43, journaled and slidable on the shaft 44. The arm 43 carries, moreover, a coil 45 of adhesive coated thread 46, constituting the jointing material per se known and ultrasonic welding device or sono-trode 47 effecting the melting of the adhesive by means of ultrasounds emitted by a generator included in the machine. At the end of the arm 43, there is provided a pneumatic cylinder 48 carried by a shaft 49, which performs the dual function of allowing the arm to be raised, and accordingly separation of the roller 42 from the sheet for carrying out adjustment operations, and of pressing the roller 42 against the sheet or strip with a force the amount of which is considered to be most suitable for proper operation.

For applying the jointing material 46 to the lower face of the wood strips, a coil 50 of adhesive material coated thread is provided which is carried by the arm 51 rigid with the sleeve 52, slidably mounted on the crossmember 53 of the machine structure; the sonotrode 54 being also connected to said arm 51.

As explained hereinabove, the described jointing material applying mechanisms are slidable transversely to the machine, by virtue of the sleeve 52 and cross member 53, thereby they can be carried at any point of the rollers 39 for applying the jointing material to the most suitable location.

Finally, there is indicated at 55 a per se known sensor adapted to detect the passing by of the wood strips, and controlling a microswitch not shown provided on the supply side of the electric motor 40; said sensor 55 being supported by a slider 56 slidable on the guide 32.

The apparatus operates as follows.

Only when the first strip laid by the operator onto the belts 1 of the feeding conveyor floor contacts both sensors 33 and 34, the strip is sufficiently aligned i.e. perpendicular to the longitudinal feeding direction of the apparatus and only then a consent is emitted by them for the raising rotation of the stop pawls 26' of the aligner 26, following a short time interval which is controlled by a timer operative to permit the strip to reach contact with said stop pawls 26'. Reverse sinking rotation of the stop pawls 26', to block the passing of the following strip which has to be aligned, occurs as the trailing edge of the just considered strip passes under the sensor 27.

It will be appreciated that the raising and sinking rotation of the stop pawls 26' is obtained by the action of a pneumatic cylinder (not shown), which acts on the shaft 26 through a crank mechanism causing rotation through about 90° of this shaft in one or the other direction. The cylinder is actuated through a per se known controlling electric circuit controlled by the above described sensors 33,34 and 27. It will be understood that, when the strip to be entrained by the feeding conveyor floor is not aligned, i.e. is not perfectly perpendicular, one of the sensors 33 or 34 is not actuated and no consent is given for the raising rotation of the stop pawls 26'. Consequently the strip is further entrained by the feeding conveyor floor until it reaches one of the stop pawls 26' with one point thereof which is prevented from moving further and slides with respect to the conveyor floor while the other portion of the strip is further entrained until alignment with the perpendicular direction occurs and also the other of the sensors 33 or 34 is actuated, giving thereby consent for the raising rotation of the stop pawls 26' after the described short time interval allowing the relevant strip portion to travel the short distance between the sensors 33 or 34 and the stop pawls 26', such distance being normally shorter than the width of the processed strip. On continuing its advance movement and with the stop pawls 26' in blocking position, the considered strip gets into contact with the sensor 28 which releases the raising rotation of the stop pawls 26' such as to allow the following strip to pass past it only if consent is given by the sensors 33 and 34, i.e. only if the following strip is in contact with both sensors 33 and 34, i.e. is aligned. An automatic control cycle of the aligner is thus established.

As the strips are transferred from the loading conveyor floor to the crowding conveyor floor, owing to the lower speed of the latter with respect to the former, the strips tend to crowd i.e. to approach each other. It will be apparent that the pressure elements 22,24 pressing the wood strips against the belts of the conveyor floors ensure against the risk of excessive slipping of the same with respect to the belts, and avoid overlapping of two consecutive strips or climbing of one strip above the other.

In fact, it will be appreciated that the pressing action of the pressing rods 22,24 which are preferably made of steel should not exceed a certain degree, since in the crowding conveyor floor a slipping of the processed strips with respect to the conveyor belts of the conveyor floors should be allowed, as hereinafter described. On the other hand the pressing action should not be excessively low, since otherwise in the feeding conveyor an uneven slipping of the strips with respect to the conveyor belts may occur and an inclination thereof with respect to the alignment direction may happen after the alignment device 26, 26'.

Moreover in the crowding conveyor floor the climbing of the strips one over the other should be prevented as above described. It will be appreciated that this controlled pressure degree of the pressing rods 22,24 against the strips to be processed is obtained on the one hand by the weight itself of the pressing rods 22,24 and the rocking support thereof and on the other hand by the controlled pressing action of the inclined pneumatic cylinders **22*c* and 24*c*. It will be understood that the point in which the cylinders 22*c* and 24*c* act is selected in the area where the danger of irregular slipping or climbing of the strips is greater. In fact, owing to the oscillatable support of the pressing rods 22 and 24 on the respective rocker arms 22*b* and 24*b* the pressing action is greater in the area of the point of action of the piston rods of the cylinders 22*c* and 24*c*. However this localized greater pressing action is compensated by the horizontal component of the inclined piston force, which creates an anticlockwise movement of rotation about the pivot 22*h*, 22*k* and 24*h*, 24*k*** as will appear clear to those skilled in the art.

It will be thus appreciated that the rod-like elements are allowed to perform limited translatory and angular adaptation movements, responsive to the thickness irregularities of the processed laminar material.

As the first strip while sliding gets in contact with sensor 55, the latter is raised and releases the starting of the motor 40, which drives the jointing material applying rollers 39, which by rotating with a lower peripheral speed than the crowding conveyor floor, exert on the strip a braking action, causing a slippage thereof with respect to the conveyor belts 7, and consequently a deceleration thereof such as to produce contact with the oncomming following strip, to thus produce the continuous sheet or ply which is jointed.

Upon rotation of the roller 39, the adhesive-coated threads 46 are progressively pressed on the one side by the driving rollers 39 and on the other side by the idle rollers 42 against the advancing jointed strips, which, while advancing under the controlling action of the rollers 39 cause rotation of the idle rollers 42, thereby to exert a pulling action on the adhesive-coated threads which are thus unwound from their coils 45 and 50 and caused to pass through the heating devices 47 and 54 thereby to cause the adhesive coating of the thread to attain a melted condition before being applied to the strips by the pressing action thereon of the rollers 39 and 42. It will be understood that the heating devices 47 and 54 may be of conventional electric resistance type.

Under normal conditions, the motor 40 is kept moving constantly on account of the achieved continuity of the sheet or ply under the sensor 55. However, if for a reason whatever, the strip supply is momentarily discontinued, and a gap is formed under the sensor 55, then the sensor 55 is lowered and the motor 40 stops to cause the jointing material applying rollers 39 to stop thereby stopping in turn the contacting sheet or ply. Since said rollers 39 will only resume their movement upon arrival of a fresh strip, it will be apparent how no discontinuity is created in the jointed sheet or ply.

It is to be noted that the output speed of the jointed ply, and accordingly the machine own output, is proportional to the speed of the joint material applying rollers 39, which as mentioned above also perform the function of frictional rollers.

Figure 1:
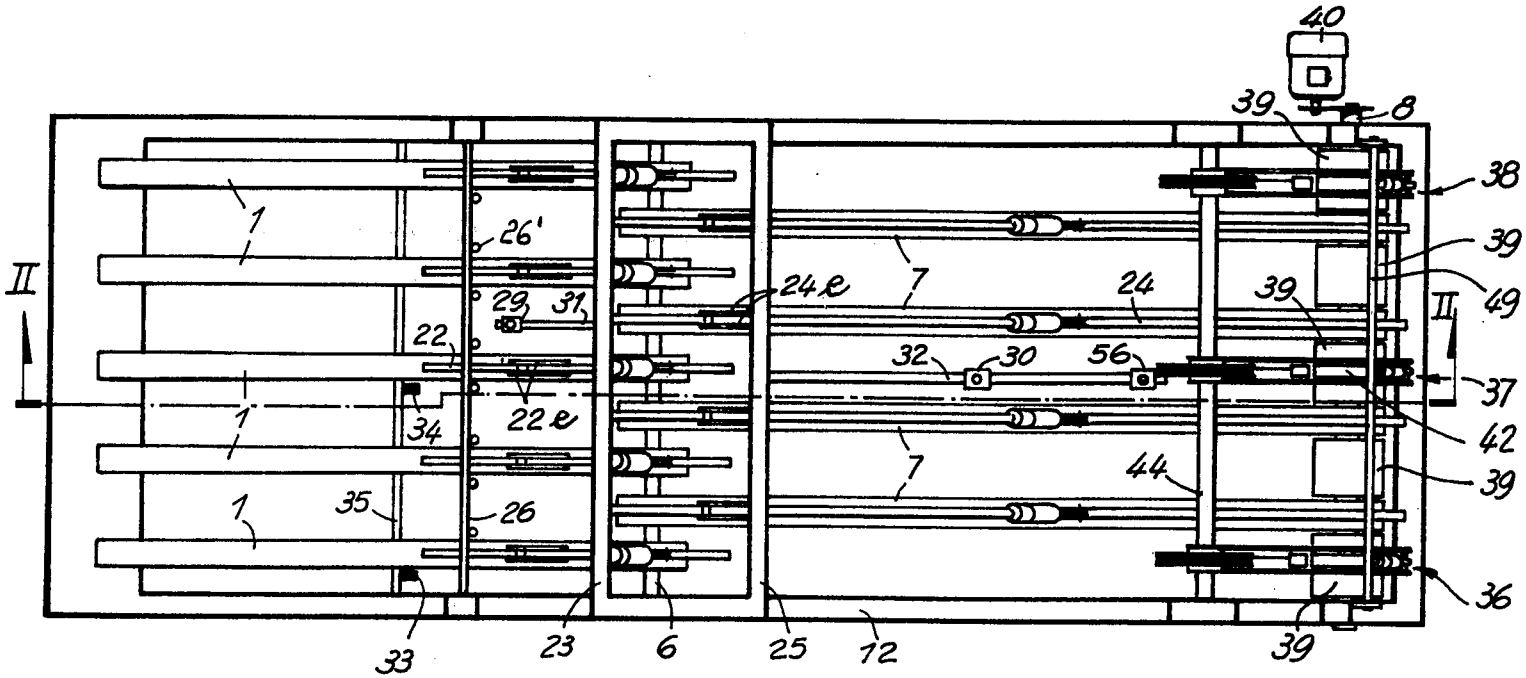
FIG. 1 is a diagrammatic plan view of the apparatus according to the invention.

In fact, as visible in FIG. 1 rollers 39 are large enough to perform such double function, taking into account that the adhesive threads are sufficiently thin for the purpose.

Finally, provision is made in the controlling circuitry for cancelling the automatic cycle described above, when it is desired to remove an undesired strip processed by the machine.

The machine described hereinabove will obviously include means or supplying the strips to this apparatus, a cutter for reducing the resulting continuous ply to size, and discharging and quick piling means.

The invention as described hereinabove is susceptible to many modifications and variations, all of which fall within the scope of this inventive concept: for example, the adhesive provided on the splicing thread could be melted by means of the heat generated by a spirally wound, and possibly encased, electrical resistor, through the inside whereof the thread is passed in the presence of a compressed air jet.

I claim:

1. An apparatus for joining pieces of laminar material, in particular wooden strips for plywood cores, including a stationary frame structure, supported on said frame structure a plurality of successive coplanar conveyor floors having a longitudinal extension, each consisting of a series of coplanar and parallel conveyor belts arranged in spaced side-by-side relationship, said plurality of successive coplanar conveyor floors including at least one feeding conveyor floor and at least one crowding conveyor floor arranged after the feeding conveyor floor and having its conveyor belts moving at a speed slower than that of the feeding conveyor floor belts to allow the crowding thereon of the strips to be joined, and pressure mechanisms for holding the strips in contact with the conveyor floors, wherein the pressure mechanisms comprise at least one rod-like element arranged over at least part of the longitudinal extension of said successive conveyor floors, said rod-like element having a smooth lower surface facing the conveyor floors and suspension means for the rod-like element and wherein according to the improvement said suspension means comprise for each rod-like element an articulated link connection allowing limited translatory and angular adaptation movements for said rod-like element and wherein said pressure mechanisms include a controlled pressure fluid operated piston-cylinder group acting on said rod-like element allowing said rod element to adapt itself under controlled pressure against the strips to be joined entrained by the conveyor floors, the apparatus further comprising alignment means arranged between said rod-like elements for aligning the strips to be joined in a direction perpendicular to the longitudinal extension of the conveyor floors and jointing material applying means.

2. An apparatus according to claim 1 wherein said articulated link connection comprises a rocker arm arranged at a distance from said rod-like element and extending normally in the same direction as said rod-like element and having an end thereof hingedly supported on the stationary frame structure, a lug rigid with said rod-like element and projecting therefrom towards said rocker arm, said rocker arm having another end thereof hingedly connected with said lug at a distance from said rod-like element and a pressure fluid operated piston-cylinder group of adjustable pressure type having one extremity thereof hingedly connected to the stationary frame structure and the other opposite extremity thereof hingedly connected to said rod-like element at a distance from said another end of said rocker arm thereby to allow limited angular and translatory adaptation of said rod-like element to the thickness irregularities of the processed laminar material while maintaining a substantially constant evenly distributed pressure thereon.

3. An apparatus according to claim 2, characterized in that said piston-cylinder group is arranged inclined with respect to said rod-like element and wherein said other opposite extremity of the piston-cylinder group is arranged near a rearward end of said rod-like element.

4. An apparatus according to claim 1, characterized in that said alignment means comprise a shaft extending transverse to said rod-like elements near the forward end thereof, at least two stop pawls arranged in the reach of the path of the strips to be processed and fixed on said shaft at a distance from each other and defining the alignment direction for said strips, at least two inlet sensors located before said stop pawls and adapted to release the opening movement thereof only when both are in contact with a strip to be processed, a third sensor being provided after said stop pawls and adapted to release the closing movement of said pawls only when the trailing edge of a strip passes thereunder.

5. An apparatus according to claim 4, characterized in that after the third sensor a fourth sensor is provided which is adapted to give consent for the opening of the stop pawls when contacted by the passing strip and preventing the opening of the stop pawl in the absence of the strip, and timer means delaying the opening action of said stop pawls.

6. An apparatus according to claim 1, characterized in that said jointing material applying means comprise a shaft extending transverse to the longitudinal direction of the apparatus and arranged at the end of the last conveyor floor thereof, a plurality of jointing material applying driven rollers keyed on said shaft, a variable speed motor for rotating said shaft and driving said rollers with a selected speed, a sensor before said rollers arranged in the path of said strips, said sensor being adapted to consent actuation of said motor when contacted by a strip and to stop said motor when out of contact with a strip to be processed, a plurality of pressing rollers arranged opposite said driven rollers to press said strips passing therebetween and allowing said driven roller to exert a braking action thereon, support means for said pressing rollers, said support means including a swingable arm, coils of jointing material carried by said arm and heating means for said jointing material.

7. An apparatus according to claim 6, characterized in that said jointing material is an adhesive-coated thread and said processing means are an ultrasonic device for heating said adhesive-coated thread.

8. An apparatus according to claim 6, characterized in that said jointing material is an adhesive-coated thread and said processing means are electric resistor based heating means for the adhesive-coated thread.

* * * * *